US007163731B2

(12) United States Patent
Yeshurun et al.

(10) Patent No.: US 7,163,731 B2
(45) Date of Patent: Jan. 16, 2007

(54) LIGHTWEIGHT ARMOR AGAINST FIREARM PROJECTILES

(75) Inventors: Yehoshua Yeshurun, Haifa (IL); Yechezkel Ashuach, Ness Ziyyona (IL); Zvi Rosenberg, Haifa (IL); Moshe Rozenfeld, Yoqeneam (IL)

(73) Assignee: Rafael Armament Development Authority, Ltd., Haifa (IL)

( * ) Notice: Subject to any disclaimer, the term of this patent is extended or adjusted under 35 U.S.C. 154(b) by 0 days.

(21) Appl. No.: 09/904,585

(22) Filed: Jul. 16, 2001

(65) Prior Publication Data

US 2002/0058450 A1 May 16, 2002

Related U.S. Application Data

(63) Continuation-in-part of application No. 09/263,845, filed on Mar. 8, 1999, now abandoned.

(30) Foreign Application Priority Data

Mar. 20, 1998 (IL) ..... 123764
Apr. 23, 1998 (IL) ..... 124190

(51) Int. Cl.
*B32B 5/12* (2006.01)
*B32B 7/00* (2006.01)
*F41H 5/00* (2006.01)
*F41H 5/04* (2006.01)

(52) U.S. Cl. ..... 428/112; 428/119; 428/189; 428/911; 89/36.01; 89/36.02; 89/36.05

(58) Field of Classification Search ..... 442/59, 442/135, 203, 250, 260; 428/112, 119, 190, 428/212, 270, 911; 89/36.01, 36.02, 36.03, 89/36.05

See application file for complete search history.

(56) References Cited

U.S. PATENT DOCUMENTS

| | | | | |
|---|---|---|---|---|
| 2,318,301 | A | 5/1943 | Eger | |
| 3,380,406 | A | 4/1968 | Gosnell | |
| 4,169,181 | A * | 9/1979 | Molari, Jr. | 428/217 |
| 4,368,660 | A | 1/1983 | Held | 89/36.17 |
| 4,594,290 | A * | 6/1986 | Fischer et al. | 428/212 |
| 4,633,528 | A | 1/1987 | Brandt | |
| 4,881,448 | A | 11/1989 | Medin et al. | 89/36.02 |
| 4,901,622 | A | 2/1990 | Perry | 89/36.02 |
| 4,989,493 | A * | 2/1991 | Blommer et al. | 89/36.02 |
| 5,293,806 | A | 3/1994 | Gonzalez | 89/36.03 |
| 5,362,527 | A * | 11/1994 | Harpell et al. | 428/33 |
| 5,443,883 | A | 8/1995 | Park | |

FOREIGN PATENT DOCUMENTS

| | | |
|---|---|---|
| BE | 877 585 | 11/1979 |
| DE | 28 15 582 | 3/1980 |
| DE | 42 37 798 | 5/1994 |
| EP | 0 287 918 | 10/1988 |
| FR | 2 731 512 | 9/1996 |

(Continued)

OTHER PUBLICATIONS

Abstract for CH643650.

(Continued)

*Primary Examiner*—Ula C. Ruddock
(74) *Attorney, Agent, or Firm*—Browdy and Neimark, PLLC

(57) ABSTRACT

An armor assembly for protecting a body disposed behind said armor assembly, wherein the armor assembly comprises at least one layer of material made of an essentially brittle material, said layer extending slanted relative the expected trajectory of an oncoming firearm projectile.

20 Claims, 2 Drawing Sheets

FOREIGN PATENT DOCUMENTS

| | | |
|---|---|---|
| GB | 1 328 576 | 8/1973 |
| GB | 2 308 401 | 6/1997 |
| WO | WO 92/20520 | 11/1992 |

OTHER PUBLICATIONS

DE-4237798, Derwent Publication Ltd., May 11, 1994.
DE-4440120, Derwent Publication Ltd., May 15, 1996.
DE-4125918, Derwent Publication Ltd., Feb. 13, 1992.
DE-2325921, Derwent Publication Ltd., Dec. 12, 1974.
DE-3741090, Derwent Publication Ltd., Jun. 22, 1989.
IL-88986, Shevach et al., "Combined Reactive and Passive Armour", Jan. 18, 1989.
IL-110736, Bodrov et al., "Reactive Protection Device Against Projectiles", Aug. 22, 1994.

* cited by examiner

LIGHTWEIGHT ARMOR AGAINST FIREARM PROJECTILES

The present application is a continuation-in-part of Ser. No. 09/263,845, filed Mar. 8, 1999, now abandoned.

FIELD OF THE INVENTION

The present invention is in the field of armor against regular and armor piercing firearm projectiles and their fragments as well as debris of various objects (collectively referred to herein the specification and claims as projectiles), and aims at providing an armor suitable for a variety of purposes such as for making protective garments, for fitting enclosures with armored wall portions and the like.

BACKGROUND OF THE INVENTION

There is a widespread need for protected enclosures with firearm projectile resistant wall portions, transparent or not. Typical examples where transparent such armor is required are shop windows in riot prone areas, armored car windows, fighter plane domes, helicopter windows, domes for a tank commander post, etc.

According to the prior art it is customary to use for such purposes laminated glass panels, e.g. 11 to 40 mm thick or even more, which by the effect of their mechanical properties are resistant against the penetration of various types of firearms. Where it is required to increase the penetration resistance of the armor, the thickness has to be increased, thereby reducing the visibility of such armor panels. Furthermore, such panels are very heavy, weighing about 3 to 4 times more than an opaque armor, and also costly and therefore impractical for many purposes. There is thus an ever increasing need for armor material, in particular lightweight and transparent armor shields.

There is also a widespread need for firearm projectile resistant pliable material, e.g. for making protective garments, bullet resistant tarpaulins and the like. There is furthermore a need for lightweight opaque armor against firearms.

Whilst prior art armor shields are aimed at providing an armor which deforms the shape of the projectile or of its fragments, thus decreasing its penetration ability by reducing its kinetic energy, it is an object of the present invention to provide an armor which diverts the trajectory of the projectile or the fragments thereof. This object is carried out whilst carrying out the above needs.

GENERAL DESCRIPTION OF THE INVENTION

It is the general object of the present invention to provide an armor which diverts the trajectory of the projectile striking said armor. This object is achieved by imparting the projectile with deflecting momentum as it penetrates through the armor, whereby the trajectory of the projectile is diverted from its original course.

The invention is based on the surprising observation that an armor made of at least one panel of brittle, low fracture toughness material, facing the expected path of a firearm projectile and slantingly oriented with respect to the path of a firearm projectile, subjects the projectile to forces which cause it to be diverted from its original trajectory by virtue of impact forces acting on the projectile as it penetrates through the armor.

Additional layers of material may be introduced behind the brittle material, thus imparting the armor further resistance and durability and to increase protection of an object extending behind the armor.

The arrangement is such that the projectile is diverted in direction essentially perpendicular to the panel of brittle material, and where the armor comprises one or more layers made of ductile material behind the panel of brittle material, the projectile and fragments of the brittle material will not reach the protected object. The one or more ductile layers may adjoin the layer of brittle material or may extent at a different angle with respect thereto.

According to one specific embodiment of the invention, the armor comprises a front layer made of an essentially brittle material and a rear layer made of ductile material, adjoining the front layer and constituting a backing layer. The rear layer i.e. the backup layer may be made of metal, typically steel or aluminum, or of a polymer e.g. PU (Polyurethane), PVC (polyvinylchloride), where transparency is required.

By one particular embodiment, the front layer is made of a woven or other pliable material, whereby the projectile is diverted by virtue of asymmetric impact forces.

According to the present invention the armor comprises a plurality of armor layers arranged in a serrated layout, the armor layers being essentially parallel to one another and extending tilted with respect to an expected trajectory of a projectile.

The material of the front and rear layers used in accordance with the present invention may be transparent or opaque. However, it is in many cases advantageous that it is made of a transparent material, whereby one can see through it. Examples of materials suitable for use as the front layer are glass, glass ceramics, Perspex™, Plexi Glass, PMMA (poly methyl metha acrylate), ALON, Sapphir, Spinelle, various synthetic materials, epoxy resins etc.—all being transparent, brittle materials. It may be monoblock, laminated or composite, e.g. a glass body sheathed between Perspex™ plates. Transparent Perspex™ plates may be covered with scratch-resistant materials e.g. glass or other suitable coatings.

In case of a transparent front layer, it is desired that the rear layer is also transparent.

Where out of the two complementary angles formed between the trajectory of the firearm projectile and the surface of said at least one front layer the obtuse angle is the upper one, the impinging firearm projectile is deflected upwards. In contrast, where the obtuse angle is the lower one an impinging firearm projectile is deflected downward.

An opaque front pliable material may, for example, be made of a heavy duty cloth material such as of Kevlar™, Spectra™, and various epoxy materials. Such materials may be used as they are in composite form, e.g. by being impregnated with a suitable different polymeric material which hardens upon curing.

If desired, a plurality of slanting front layers may be formed together into a multi-layer block in which adjacent layers are suitably glued or cemented to each other. In cases of a thick front layer the projectile may be deflected without penetration.

In operation an oncoming firearm projectile penetrates the at least one front layer and when it emerges therefrom, either intact or broken up, it is deflected from its trajectory, and does not penetrate the protected object. In some cases the projectile will not penetrate through the front layer, made of a brittle, low fracture toughness material.

BRIEF DESCRIPTION OF THE DRAWINGS

For better understanding the invention and to see how it may be carried out in practice, some embodiments will now be described, in a non-limiting manner, with reference to the accompanying drawings, in which.

DESCRIPTION OF SPECIFIC EMBODIMENTS

Figure 1:
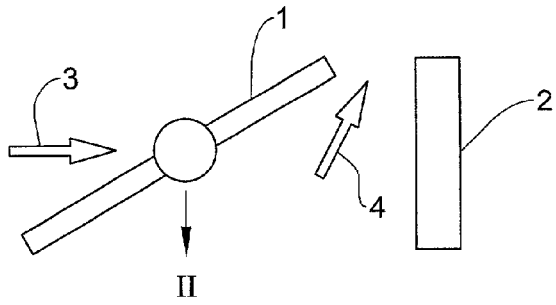
FIG. 1 is a schematic illustration showing the manner in which the invention operates in case of armor made of a single slanted layer made of a brittle material.

Turning first to FIG. 1, there is shown schematically an armor assembly comprising a slanted armor panel 1 extending in front of a body 2 which is to be protected by the armor panel 1. An oncoming firearm projectile 3 is depicted in form of an arrow and as can easily be concluded from the figure, the trajectory of projectile 3 is essentially normal to the body 2, whilst the armor panel 1 extends at a slant with respect to the trajectory of projectile 3.

In the embodiment of FIG. 1 the armor panel 1 is made of an essentially brittle, low fracture toughness material, such as, for example, glass, glass ceramics, Perspex™, Plexi Glass, PMMA (Poly Metal Meta Acrilate), ALON, Sapphir, Spinelle, various synthetic materials, epoxy resins, etc. The armor panel 1 may be transparent or opaque, depending on the intended use of the armor assembly. Furthermore, the panel 1 may be monoblock, laminate or composite, e.g. a glass body sheathed between Perspex™ plates or Transparent Perspex™ plates, which may be covered with scratch-resistant materials e.g. glass or other suitable coatings.

The arrangement in accordance with this embodiment is such that as the projectile penetrates through the armor panel 1 it is imparted side impact which cause it to deflect from its original trajectory and maintain its deflection as it emerges from the armor panel 1 in direction of arrow 4. It is appreciated that in some cases the projectile will not even penetrate through the front body.

As can further be seen, of the two angles formed at the intersection of the trajectory of projectile 3 with armor panel 1, the obtuse angle is the upper one. In consequence, once the projectile 3 has penetrated across panel 1 it is diverted upwards as shown by arrow 4, either as a whole or broken up, and either does not at all hit the body 2, or else is readily intercepted by it without passing across.

An advantage of the armor assembly according to the present invention is that it is essentially lightweight such that it is suitable for use as a personal armor garment, etc. According to some particular embodiments the armor is transparent, rendering it suitable for use as a protection armor for protecting windows and domes of vehicles and crafts, etc.

The arrangement according to this embodiment is such that owing to impact forces the projectile is imparted asymmetric impact forces as it penetrates through the panel, whereby it is diverted from its original trajectory i.e. essentially normal to the plane of the panel, as resembled by the arrow 4.

Figure 2:
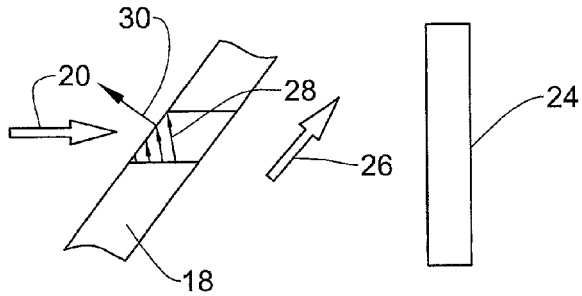
FIG. 2 is a schematic enlargement of a portion of the armor according to FIG. 1, illustrating forces acting during penetration of a projectile through the armor.

In FIG. 2, which is an enlargement of the portion designated II in FIG. 1, there is illustrated a portion 28 of the armor panel designated 18, which gives rise to generating the impact forces acting on the projectile 20, thus imparting it a component force in direction of arrow 30 diverting it in the direction of arrow 26, preventing it from reaching protected body 24, or significantly reducing its kinetic energy.

Figure 3:
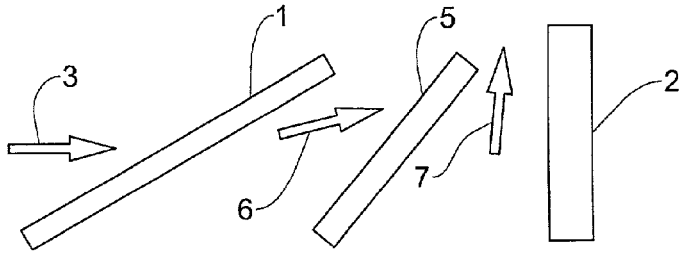
FIG. 3 is an illustration for two successive slanted armor layers, both made of a low fracture toughness material.

In the embodiment shown schematically in FIG. 3, in which similar components are marked by similar numerals, there are provided two differently slanted panels 1 and 5. In this arrangement the oncoming firearm projectile 3 is deflected by panel 1 in the manner shown at 6 at which it may still be in a position to penetrate across the second (rear) panel 5 where it is again deflected into the direction shown by arrow 7, the end result being similar as in FIG. 1 but with a larger deflection of the projectile from its original trajectory. The rear layer may be made of a metal e.g. steel or aluminum, or of a polymer e.g. PU (Polyurethane), PVC (polyvinylchloride), where transparency is required.

Figure 4:
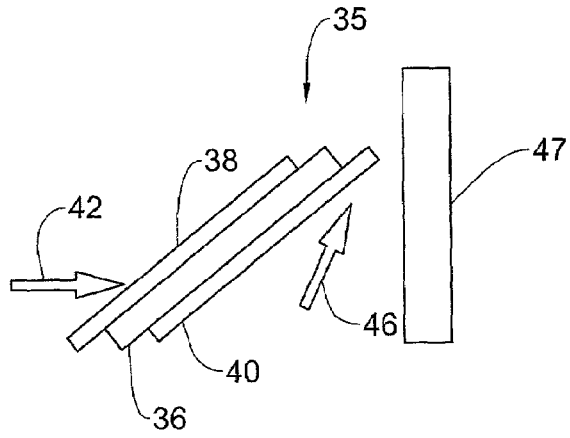
FIG. 4 is a schematic illustration of an embodiment according to the present invention, with the armor being a composite body comprising several layers.

In the embodiment of the invention schematically shown in FIG. 4, panel 35 is inclined with respect to the expected trajectory of a projectile, and comprises several layers. A middle layer 36 made of a brittle material and is sheathed by a front layer 38 made for example of a pliable material e.g. heavy duty cloth material such as of Kevlar™, Spectra™ and a rear layer 40 of a low toughens fracture material. Layers 38 and 40 are suitable for protecting the panel 36 and preventing shrapnel and debris of the panel 36 from striking object 47. This embodiment operates in a combined way namely, the projectile 42 is imparted asymmetric impact forces as it penetrates through the layer 36 and then the projectile emerges from layer 40 as indicated by arrow 46, diverted from its original trajectory path preventing it from hitting the protected body 47.

Figure 5:
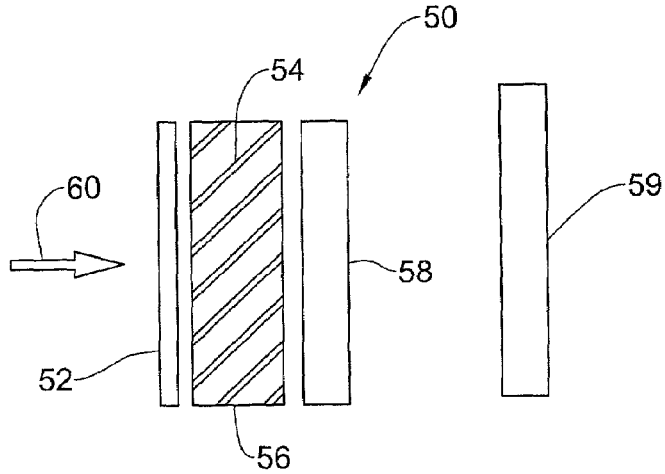
FIG. 5 is a schematic illustration of still another embodiment of the invention.

The embodiment shown schematically in FIG. 5 discloses an armor panel generally designated 50 and comprising a front layer 52 and a block 54 composed of a plurality of slanting plates 56 glued or cemented together. A rear layer of ductile material 58 extends as a backing behind the panel/block 54 and in front of the body to be protected 59. In its passage across block 54 the firearm projectile 60 is diverted by any of the plates 56 which it hits on its way, and it accordingly does not penetrate the rear layer 58.

Figure 6:
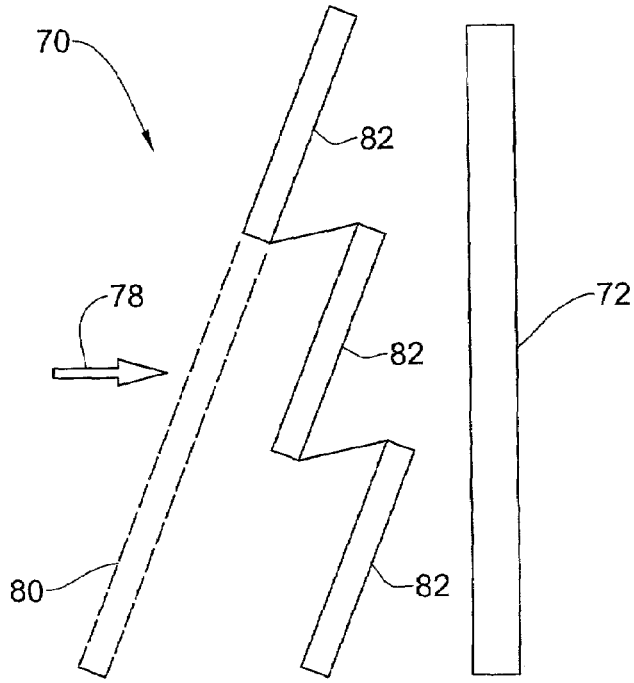
FIG. 6 is a schematic representation of an armor according to the invention illustrating a serrated structure suitable for protecting a large object.

The schematic illustration of FIG. 6 represents a protective armor generally designated 70 for protecting an object 72. It is readily understood that in order for the armor to extend in front of object 72 and inclined with respect to the trajectory of an expected threat 78, it would have to extend as illustrated by the dashed line portion 80 and would consume a significantly large space. Accordingly, the armor consists of a plurality of parallelly extending sections 82, consuming less space.

The invention claimed is:

1. An armor assembly for protecting a body disposed behind said armor assembly from oncoming regular and armor piercing firearm projectiles striking said armor assembly, wherein the armor assembly comprises a front panel including at least one armor layer made of a light-weight brittle material selected from the group consisting of poly methyl methacrylate (PMMA) and epoxy resin, said armor layer being slantingly oriented relative to the expected trajectory of the oncoming projectile and being slantingly oriented to the body being protected, and said armor layer constituting means for deflecting the projectile from its original course.

2. An armor assembly according to claim 1, wherein said front panel includes a plurality of layers, at least one of which is made of a material selected from the group consisting of poly methyl methacrylate (PMMA) and epoxy resin.

3. An armor assembly according to claim 2, wherein said armor layer is covered with a layer of brittle material.

4. An armor assembly according to claim 3, wherein said brittle material is glass.

5. An armor assembly according to claim 1, comprising a plurality of armor layers made of PMMA or epoxy resin and arranged in a serrated layout, the armor layers being essentially parallel to one another and slantingly oriented with respect to the expected trajectory of the oncoming firearm projectile.

6. An armor assembly according to claim 1, comprising a rear panel situated behind the front panel.

7. An armor assembly according to claim 6, wherein the rear panel is made of a ductile material.

8. An armor assembly according to claim 7, wherein said ductile material is pliable.

9. An armor assembly according to claim 6 wherein said rear panel adjoins the front panel.

10. An armor assembly according to claim 9 wherein said rear panel constitutes backing for the front panel.

11. An armor material according to claim 1, wherein said armor layer is made of a transparent material.

12. An armor assembly according to claim 1, wherein said armor layer is opaque.

13. An armor assembly according to claim 1, wherein said front panel is made of a monoblock.

14. An armor assembly according to claim 1, wherein said front panel is made of a composite material.

15. An armor assembly according to claim 1, wherein said front panel is made of a plurality of different lightweight transparent materials.

16. An armor assembly according to claim 1, wherein the front panel consists of a plurality of individual sublayers, wherein the individual sublayers are slantingly oriented with respect to the expected trajectory of the oncoming firearm projectile.

17. An armor assembly according to claim 1, wherein said armor layer is such that the firearm projectile penetrates it, and when it emerges therefrom, either intact or broken up, it is deflected from its trajectory.

18. An armor assembly according to claim 1, wherein the armor layer is thick, such that the projectile is deflected without penetration.

19. An armor assembly for protecting a body disposed behind said armor assembly from oncoming regular and armor piercing firearm projectiles striking said armor assembly, wherein the armor assembly comprises a front panel composed of a plurality of plates, said plates being made of a light-weight brittle material selected from the group consisting of poly methyl methacrylate (PMMA) and epoxy resin and slanting in respect of the expected trajectory of said oncoming projectile, so as to divert said projectile when impacting said plates, and said plates being slantingly oriented to the body being protected.

20. An armor assembly for protecting a body disposed behind said armor assembly from oncoming regular and armor piercing firearm projectiles striking said armor assembly, wherein the armor assembly comprises a front panel having a front surface and including at least one armor layer made of a light-weight brittle material selected from the group consisting of poly methyl methacrylate (PMMA) and epoxy resin, said armor layer being coextensive with said front surface and slantingly oriented relative to the expected trajectory of the oncoming projectile, and said armor layer being slantingly oriented to the body being protected.

* * * * *